US008322280B2

(12) United States Patent
Kuhlenschmidt et al.

(10) Patent No.: US 8,322,280 B2
(45) Date of Patent: Dec. 4, 2012

(54) DEVICE FOR APPLYING INFORMATION ONTO A SURFACE OF AN AIRCRAFT

(75) Inventors: Birgit Kuhlenschmidt, Hamburg (DE); Daniel Lahidjanian, Hamburg (DE); Dirk Bausen, Harsefeld (DE); Karl Hausmann, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 432 days.

(21) Appl. No.: 12/559,055

(22) Filed: Sep. 14, 2009

(65) Prior Publication Data

US 2010/0083853 A1 Apr. 8, 2010

Related U.S. Application Data

(60) Provisional application No. 61/103,410, filed on Oct. 7, 2008.

(51) Int. Cl.

| | |
|---|---|
| ***B41F 17/00*** | (2006.01) |
| ***B41F 31/00*** | (2006.01) |
| ***B41K 1/38*** | (2006.01) |
| ***B41K 1/44*** | (2006.01) |

(52) U.S. Cl. ..... 101/42; 101/327

(58) Field of Classification Search ..... 101/41, 101/42, 45, 93, 103, 109, 112, 327, 333
See application file for complete search history.

(56) References Cited

U.S. PATENT DOCUMENTS

| | | | | |
|---|---|---|---|---|
| 2,654,311 | A * | 10/1953 | Costanzo | 101/4 |
| 2,777,385 | A * | 1/1957 | Bachy | 101/42 |
| 3,521,555 | A * | 7/1970 | Szilagyi et al. | 101/103 |
| 4,683,821 | A | 8/1987 | Berberich | |
| 4,803,922 | A | 2/1989 | Dennesen | |
| 5,065,674 | A * | 11/1991 | Kobayashi et al. | 101/44 |
| 2008/0236414 | A1 * | 10/2008 | De Volder | 101/41 |

FOREIGN PATENT DOCUMENTS

| | | |
|---|---|---|
| DE | 235603 A1 | 5/1986 |
| DE | EP 0217976 | 4/1987 |

OTHER PUBLICATIONS

German Office Action from DE 10 2008 042 647.4 dated Apr. 22, 2009.

* cited by examiner

*Primary Examiner* — Judy Nguyen
*Assistant Examiner* — Leo T Hinze
(74) *Attorney, Agent, or Firm* — Jenkins, Wilson, Taylor & Hunt, P.A.

(57) ABSTRACT

The invention relates to a device for applying information onto a surface of an aircraft, wherein the information is applicable in variable locations and is modifiable. The device can include a pad unit having at least one pad, at least one hand grip, a press-on mechanism, a hand lever, at least one support, and a housing. By applying varying printing patterns to the pads, any combination of characters can be stamped on. Moreover, the device configured as a hand-held tool can be operated by a user in variable locations. The printing process is effected by operating the hand lever, causing the pads to be brought into contact with the surface, and the information or, as the case may be, the technical coding to be applied onto said surface.

11 Claims, 3 Drawing Sheets

DEVICE FOR APPLYING INFORMATION ONTO A SURFACE OF AN AIRCRAFT

CROSS-REFERENCE TO RELATED APPLICATIONS

This application claims the benefit of U.S. Provisional Application No. 61/103,410, filed Oct. 7, 2008, the entire disclosure of which is herein incorporated by reference.

FIELD OF THE INVENTION

The invention relates to a device for applying information, in particular a technical coding, onto a surface of an aircraft, in particular onto an aircraft surface, the information being applicable in variable locations and modifiable.

In order to facilitate maintenance work, the components of aircraft are provided with a number of technical markings. Generally, different components of an aircraft, such as the wings, horizontal tail surfaces, vertical tail surfaces and various portions of the fuselage structure are each provided with specific codings. Subcomponents within a superordinate module are in turn provided with subcodings. Service engineers can thus quickly and clearly identify a specific component, such as a flap fairing below a wing, and carry out any maintenance work which may be necessary. Owing to the extreme complexity of modern passenger aircraft, a very large number, in some cases up to 1,000, markings of this type are required, said markings previously being produced by way of labels.

However, the adhesive labels currently used for the technical marking of aircraft present a number of drawbacks.

On the one hand, accurate positioning on the substrate is difficult and it is not possible to make any subsequent corrections by removing a label which has already been applied without ruining said label. Furthermore, a number of different labels have to be kept for each type of aircraft, thus increasing storage costs. Apart from this, the labels stick better to some substrates than to others. Since an increasing number of different materials, such as aluminium alloy sheets, composite materials, coatings and sealants, can be combined with one another within the field of aircraft construction, the respective different adhesive force poses a further problem. Apart from this, labels having a large surface area in particular can only be applied to curved surfaces to a limited extent owing to their laminar shape.

In addition, the labels are exposed to many unfavourable influences when on the surface of the aircraft. The labels used must thus be able to withstand, inter alia, extreme variations in temperature between −60° C. and +120° C. and therefore conditional expansion effects, variations in atmospheric humidity and strong erosion effects caused by the oncoming airflow at high flight speeds. The labels are also exposed, particularly around the effective aerodynamic surfaces, to aggressive fluids, such as the hydraulic fluid used in actuators. Furthermore, owing to the aforementioned influential factors, the service life of the markings previously obtained using labels is considerably shorter than the service life of a lacquer for a passenger aircraft. In order to achieve a generally reasonable service life of the labels conventionally used, said labels are now provided with a clear lacquer (known as a 'clear coat') after being applied, production and application costs thus being increased further. Owing to their thermal effect, other alternative systems for marking aircraft, for example laser marking systems, damage the integrity of the final lacquer coating and make them, and thus the components to be protected, more susceptible to harmful environmental influences. The attractiveness of the overall appearance is also reduced owing to discolouration of the markings thus produced.

SUMMARY OF THE INVENTION

The object of the invention is therefore to overcome the drawbacks of providing complex markings on aircraft using a plurality of adhesive labels.

The object according to the invention is achieved by a device having the following features of claim 1:

a) a pad unit comprising at least one pad which is made of a silicone-free rubber having ashore hardness suitable for the operating conditions of the device and which is hollow on the inside, at least in part;

b) at least one hand grip;

c) a press-on mechanism for the pad unit;

d) at least one support which rests against the surface; and e) a housing;

wherein a printing pattern is formed on the at least one pad with a polyurethane lacquer containing at least two components.

The configuration of the device in accordance with features b) and e), which relate to a housing which can be handled by an engineer at least ambidextrously and has at least one hand grip arranged therein, enables the device to be used in a mobile manner within the region of the entire surface of an aircraft. The information required on the aircraft, usually in the form of technical codings consisting of any sequence of numbers, letters and/or pictographs, can thus be applied to practically the entire aircraft, generally without the need for further aids. The pad unit comprising at least one pad in accordance with feature a) makes it possible to wet at least one pad with a suitable printing ink in the respective desired printing pattern which corresponds to information to be applied onto the surface, for example onto an aerodynamic flap, of the aircraft. The at least five pads required for producing codes containing at least five characters may be fixed inside the pad unit using any type of locking or clamping connections as adaptors. The pads may thus be replaced if necessary, for example once worn. Alternatively, the pads may, for example, also be retained using a hook-and-loop connection and/or be magnetically received in the pad unit. The pad unit is removably connected to the press-on mechanism so as to enable the pads to be wetted easily with the printing pattern in a generally separate wetting station.

By way of the support and press-on mechanism in accordance with the other features c) and d), on the one hand, the device and therefore the information to be applied can be precisely positioned on the aircraft surface, and on the other hand, it is ensured that the pads carrying the printing pattern following a wetting process are pressed with a defined pressure against the surface of the aircraft. The information applied using the device thus has an accurate shape, good contrast and its outline is sufficiently defined.

By using a polyurethane lacquer, which contains at least two components a relatively high service life can be achieved compared with conventional markings using adhesive labels which are subsequently provided with a clear coat, this service life generally corresponding to the service life of a final lacquer coating.

In accordance with an advantageous embodiment of the device, the pad can be wetted with a printing pattern in a wetting station.

It is thus possible, for example using only one (printing) pad or printing cushion, to apply any number of letters or numbers to the surface of the aircraft.

A further embodiment provides for a complex printing pattern to be formed by a combination of at least two printing patterns on at least two pads.

In this case, any complex information can be formed by combining the printing patterns on the individual pads in a suitable manner.

A development of the device provides for a wetting station to comprise at least one printing block with at least one character die, it being possible to insert the printing ink, with no excess, into the at least one character die by way of at least one blade.

The character die is a negative image of the information to be applied and is also a mirror image of the printing pattern. A depth of up to 0.3 mm of the character die is generally adequate for a sufficient coating thickness of the marking. If the character die is deeper, there is the risk that the coating thickness of the information or characters applied will be too great, which may lead to running and cause the outline of the stamped sequence of characters to be rather undefined. For each character to be applied onto the aircraft surface, the generally metal printing block comprises a corresponding character die, of which the shape corresponds to the shape of the respective character to be applied.

By way of the blade, which is preferably formed with a resilient silicone-free rubber lip, the exact amount of printing ink required to fill the matrix fully and be flush is spread into the character die. Any excess printing ink is removed when the blade is slid back.

Instead of a printing block, the wetting station may, for example, be fitted with peripheral resilient continuous bands, on the upper face of which a plurality of characters in the form of raised projections having a corresponding peripheral outline (counter dies) are arranged, said projections being wetted with the printing ink either continuously or selectively after the character has been selected, similarly to date stamps. By pressing the respective pad onto the counter die arranged upstream and selected by the movement of the band, the printing pattern is transferred from said die to the upper face of the pad. Owing to the at least one band comprising a practically unlimited amount of counter dies (provided the band is sufficiently long and wide), a relatively large amount of different characters can be stored compared with a printing block having a limited surface area.

Furthermore, the wetting station may comprise a plurality of metal cylinders each having an approximately polygonal cross-section, said cylinders being rotatably mounted on a common shaft. The cylinders may be rotated on the common shaft either manually or in a motor-driven manner, and controlled by control and/or regulating means. The cylinders thus lock specifically into angular positions, of which the number of degrees is obtained from the calculation 360°/n, the variable n corresponding to the number of planar or slightly curved lateral faces of the respective cylinder polygon and the value 360° corresponding to the full circle.

The characters required for forming the dies are etched onto the substantially planar lateral faces of the cylinders. By rotating the cylinders on the shaft, practically any number of character combinations can be set inside a receiving aperture arranged transverse to the cylinders and at a small distance above said cylinders. The rectangular recess in the receiving aperture is only slightly larger than the surface area of the pad unit in the region of the pads. In the region of the receiving aperture, the printing ink is brushed into the selected character dies, for example using a blade or the like, once the cylinders have been positioned. The pad unit is then guided into the recess of the receiving aperture so as to remove the printing ink from the cylinders. For this purpose, the receiving aperture may comprise a receptacle for centering the pad unit. It is also possible to completely fit the device, with the pad unit received therein, on the receptacle, to lock said device to the receptacle and to wet the pads with the desired printing patterns by actuating the hand lever. In this configuration it is no longer necessary to remove the pad unit from the hand-held tool before the pads are wetted in the wetting station. Once the wetting process is complete, the device can be removed from the receiving aperture and is ready for use. The wetting station may also be configured with longer metal strips which are arranged next to one another and are mobile parallel to one another, in the upper face of which strips a plurality of different character dies is etched. A receiving aperture extends transverse to the metal strips. The receiving aperture is, inter alia, an orientation aid when positioning the pad unit when the printing ink is applied to the upper faces of the metal strips. By correspondingly moving the metal strips relative to one another a large number of characters and/or symbol sequences can be arranged below the receiving aperture. The metal strips may be positioned parallel to one another either manually or in a motor-driven manner, controlled by a control and/or regulating means.

Alternatively, colour may also be sprayed onto the pads by way of a printing head. The printing head thus contains a plurality of die-shaped spray nozzles which are supplied from a central printing ink reserve. Any sequences of characters and symbols can thus be sprayed or squirted onto the upper face of the pads using only a single printing head which can be moved along the pad unit by way of a positioning device. By using only one printing head, any sequence of characters can be programmed using only changes in software inside the control and/or regulating means of the wetting station, in such a way that a practically unlimited number of variations of the character set is obtained. In particular, a planar, one-piece plate-shaped printing block has the advantage over the printing block which can be variably adjusted using cylinders and metal strips, that there are no joints or gaps in which the printing ink can accumulate. The formation of any interfering stripes when the printing pattern is transferred from the printing block to the upper face of the pad is thus largely avoided. In contrast, the variably adjustable printing block has the advantage that the pads do not have to be individually mobile within the pad unit in a vertical direction and the wetting station is of considerably simpler construction, since the there is no need to position the printing block in the x and y directions.

In accordance with a development of the device, it is provided for the printing ink located in a selected character die to be removable from said die by way of the at least one pad and to be transferable to an upper face of the pad so as to create a corresponding printing pattern.

By way of the ideally loss-free transfer of the printing ink between the character die and the upper face of the pad concerned, a high level of printing quality can be achieved.

A development of the invention provides for the printing block to be a planar plate, it being possible to select a plurality of different character dies for wetting each pad by moving the pad unit received in a holder and/or the plate relative to one another by means of at least two positioning means.

In its function as a printing block the plate is preferably rectangular, circular, oval or elliptical with a constant material thickness in each case. The plate is preferably made using a steel alloy, so as to achieve sufficiently long service lives for a plurality of wetting, printing and stamping processes as well as a constant printing quality and so as to avoid excessive signs of wear.

In order to apply a character to the aircraft surface, the pad unit is first removed from the (printing) device and inserted into a suitably configured receptacle of the holder inside the wetting station, which is generally separate. The printing ink is then brushed into the character die of the printing block using a blade. This may also take place selectively. The desired character die is selected, for example by moving the plate parallel to the y-axis and by moving the holder with the pad unit parallel to the x-axis. Once the pad to be wetted is positioned above the desired character die, the entire pad unit first approaches the die by being lowered parallel to the z-axis. When sufficiently close, the relevant pad is pushed out of the pad unit by a magnetic push rod associated with said pad and wetted with the desired printing pattern. In order to transfer the printing ink, it is vital that an adhesion between the character die and the printing ink is less than the adhesion between the upper face of the pad and the printing ink. Owing to the fact that the pad unit may be positioned anywhere above the printing block or plate, a plurality of different printing patterns can be transferred from only one printing block or plate to the selected pad in conjunction with the pad selectively pushed out of the pad unit. Depending on the number of pads, practically any number of character sequences can thus be formed on the plate from a limited supply of character dies. The pad unit and/or the (printing block) plate can be positioned in the x, y and z directions by way of actuators, such as electromotive spindle drives, stepping motors or the like.

The process is repeated in the wetting station for all pads provided in the device so as to transfer all the information to be applied to the upper faces of the individual pads. In order to finally apply the information to the aircraft surface, the pad unit with the transferred printing patterns is removed from the wetting station and inserted into the printing or stamping device. By pressing the pad unit against the aircraft surface using an appropriate press-on mechanism, a marking can be applied at any location. Different structural variants may serve as a press-on mechanism, for example lever drives, rack-and-pinion drives, magnetic drives, electromotive, hydraulic or pneumatic drives. Preferred press-on mechanisms are those which generate no electrical discharge so the likelihood of an accident in explosion-risk areas is reduced.

The wetting station is preferably completely mobile and independent of the hand-held tool so as to allow a small spatial distance towards the application point of the printing pattern and thus minimise any labour involved. For example, the wetting station may be assembled on an underwagon or be miniaturized to such an extent that a worker is able to keep the wetting station on his person by way of suitable aids, for example carrying or harnessing straps. The wetting station can in principle be configured as an integral component of the device.

Other advantageous embodiments of the device are disclosed in the other claims.

DETAILED DESCRIPTION OF THE DRAWINGS

Figure 1:
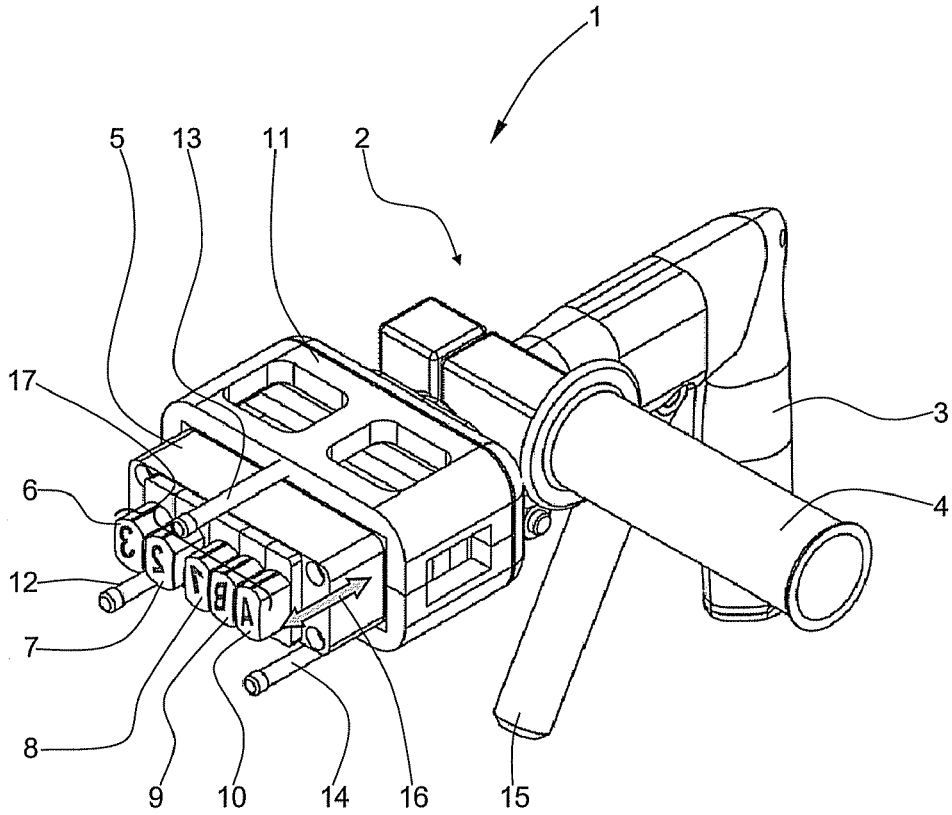
FIG. 1 is a perspective view of the hand-held device according to the invention.

FIG. 1 is a perspective view of the device according to the invention. A device 1 configured as a hand-held device comprises, inter alia, a housing 2, two hand grips 3 and 4 arranged on the housing 2 and offset at 90° to one another, a pad unit 5 with a total of five pads (printing cushions) 6 to 10 which are surrounded at their edge by a retainer 11 and are moveably received in said retainer. Three projecting rods 12 to 14 which act as contact points on an aircraft surface (not shown) to be marked using the device 1 are arranged on a peripheral edge of the retainer 11 rigidly connected to the housing 2. Alternatively, the pad unit 5 may be configured so as to be stationary. The retainer 11 may be flexible so as to better adapt to the respective shape of the surface of the component to be marked. Alternatively, it may be possible to replace the retainer 11, so as to use different retainers which are adapted to the various curvatures of components.

Owing to the three projecting rods 12 to 14, the device 1 can be accurately positioned in a steady manner relative to the surface. Rubber buffers or suckers which can be removed by the user are arranged at each of the ends of the projecting rods 12 to 14 so as to prevent the final lacquer coating from being damaged and so as to also ensure steady positioning on the aircraft surface. A constant distance between the surface and the pads 6 to 10 when the device 1 is in an 'idle position' is also ensured by the projecting rods 12 to 14.

By manually actuating the hand lever 15, the pad unit 5 (including the pads 6 to 10 fixed therein) can be moved in the direction of the double-headed white arrow 16 relative to the retainer 11 and to the housing 2 into a 'printing or stamping position'. In order to apply the lettering or technical coding "AB 123", for example, to a component, an upper face of the pad 6 is wetted with a "3" printing pattern, an upper face of the pad 7 is wetted with a "2" printing pattern, an upper face of the pad 8 is wetted with a "1" printing pattern, an upper face of the pad 9 is wetted with a "B" printing pattern and an upper face of the pad 10 is wetted with an "A" printing pattern. The printing patterns are preferably made of a curable, highly resilient polyurethane lacquer (PUR lacquer) which contains at least two components, in particular a base, a hardener and optionally a thinner. The wetting process with the desired printing patterns is carried out in a separate wetting station (see FIGS. 3 to 6). The upper faces of the pads 6 to 10 are each slightly convex, i.e. spherically curved. The pads 6 to 10 are made of a silicone-free rubber, of which the shore hardness is adapted to the respective operating conditions. The pads 6 to 10 may be solid or hollow on the inside, at least in part.

Once the hand lever 15 has been actuated by a user, the pads 6 to 10 are brought into contact with the aircraft surface with a defined force of up to 50 N so as to apply the lettering "AB 123" as a (complete) printing pattern 17, that is to say when the pad unit 5 is pushed out. The individual printing patterns "A" to "3" are simultaneously transferred to the aircraft surface. By wetting the upper faces of the pads 6 to 10 with a selection of different printing patterns from a limited pool of printing patterns, an extremely large number of different character sequences can be produced by the combination of only five pads 6 to 10, this number being considerably greater than the number of modules to be marked on the aircraft. The pad unit 5 is also configured in such a way that, if necessary, it is easy to replace the pads 6 to 10 received in said unit. This may be necessary, for example when there is wear, if the pads 6 to 10 are at different heights after extensive use and the printed image is thus of lower quality, or if it is necessary to use pads having different levels of hardness or pads of a different size and/or shape. The pads may be exchanged using adapters which form the connection between the pads 6 to 10 and the pad unit 5. The adapters may, for example, work using clamping or locking connections, hook-and-loop connections or strong permanent magnets. Furthermore, the pad unit 5 enables the individual pads 6 to 10 to be positioned relative to one another so as to be horizontally flexible, said positioning process being carried out by way of connectors (not shown). The adapters for connecting the pads 6 to 10 to the pad unit 5 are particularly preferably configured as a combined pin-magnet connection.

Once the hand lever 15 has been released by a user, the pad unit 5 is automatically pulled back again by way of spring tension into the 'idle position'.

Figure 2:
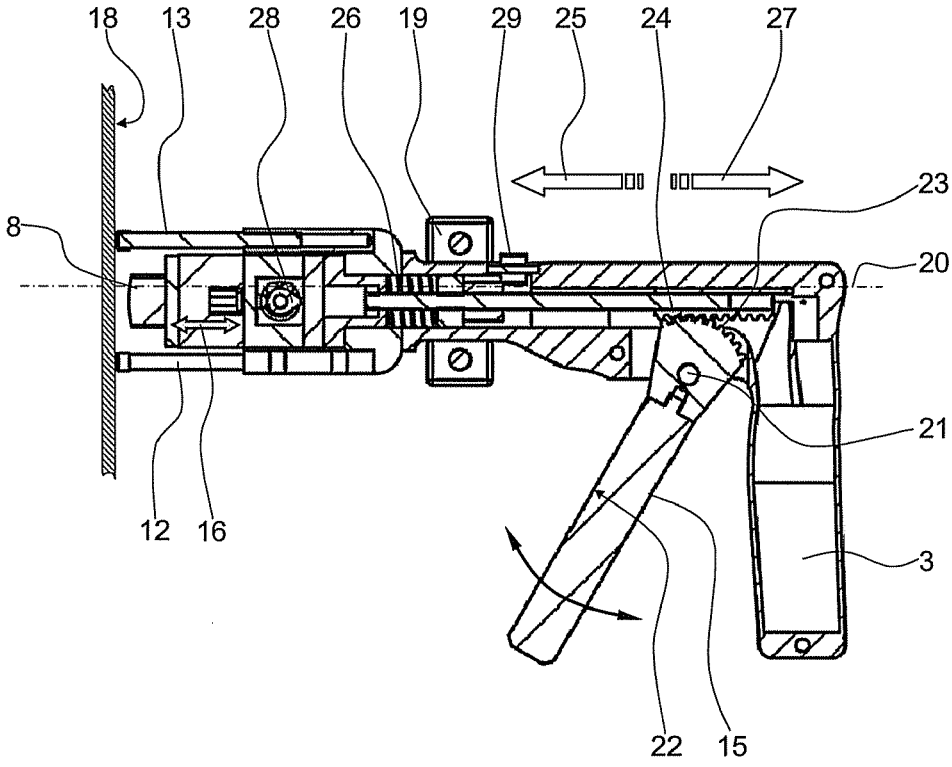
FIG. 2 is a longitudinal section through the device.

FIG. 2 shows a longitudinal section through the device according to FIG. 1. The device 1 is in the 'idle position', i.e. the pad unit 5 with the pads 5 to 10 is in a position in which it has been removed from a surface 18, whilst the projecting rods 12 to 14 project until they contact the surface 18 of the aircraft (not shown in the figures) to be marked. The first hand grip 3 is arranged on the end face of the housing 2, whilst the optional second hand grip 4 (not visible in FIG. 2) projects perpendicular to the drawing plane and is rigidly clamped to the housing 2 by way of the metal fitting 19. It is thus possible to pivot the second hand grip 4 anywhere about a longitudinal axis 20 of the device 1 and to fix it in place, the handling thus being improved for a user. The hand lever 15 is rotatably received in a point of rotation 21 inside the housing 2 and has an ergonomic gripping portion 22 at a lower end and a tooth portion 23 at an and remote from said lower end. The tooth portion 23 is engaged with a toothed rack 24, so as to transform the circular movement of the hand lever 15 during actuation into a horizontal movement of the toothed rack 24 along the longitudinal axis 20 in the direction of an arrow 25. The toothed rack 24 is connected to the pad unit 5, possibly via an optional connecting rod (not shown) so as to be adjustable in length in the direction of the longitudinal axis 20. By way of said adjustment in length, a distance between the upper faces of the pads 6 to 10 and the surface 18 of the outer skin of the aircraft to be marked is set in the idle position of the device 1 and may optionally be subsequently adjusted, if necessary, after longer periods of use. A tension spring 26 is also arranged coaxially on the toothed rack 24, which spring pulls the pad unit 5 and the toothed rack 24 connected therewith back in the direction of a further arrow 27 when the hand lever 15 is released. The hand lever 15 with the tooth portion 23 of the toothed rack 24, the tension spring 26 and the pad unit 5 form the main parts of the press-on mechanism of the device 1.

A transmission may be provided in the press-on mechanism so as to change the pressure depending on the position of the hand lever 15. The hand lever 15 may also comprise a free-wheel so as to prevent a user's hand from being caught when the pad unit 5 is pulled back. The pad unit 5 may be removably connected, preferably manually, by way of a lock 28 (not shown in detail). A set wheel 29 is also provided in the housing so as to vary a biasing of the tension spring 26. The spring bias of the tension spring 26 must be set, inter alia, so as to compensate different levels of hardness of the respective pads 6 to 10 used. The irreversible compression of the pads 6 to 10 resulting after longer periods of use is also compensated.

The device 1 may be fitted with positioning aids (not shown in greater detail) so as to enable the lettering to be applied at precisely defined angles of, for example 0°, 45° or 90°. Notches, for example, in the region of the retainer 11, laser sources, for example laser LEDs, emitting linear rays, and spirit levels with a variable angular adjustment may be used as positioning aids.

Figure 3:
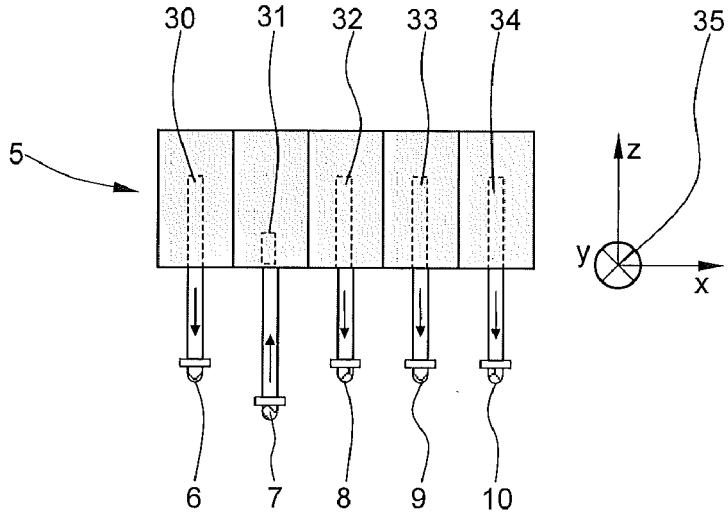
FIG. 3 is an enlarged view of a pad unit.

FIG. 3 illustrates a detailed view of the pad unit according to FIGS. 1 and 2.

The pad unit 5 has a total of five magnetic push rods 30 to 34, to each of which one of the pads 6 to 10 is fixed. The magnetic push rods 30 to 34 make it possible to move the pads 6 to 10 in a vertical direction by way of a short stroke parallel to the z-axis of a coordinate system 35 via a current flow, controlled by a control and regulation means, through electromagnets (not shown) inside the magnetic push rods 30 to 34. Adapters may be provided between the magnetic push rods 30 to 34 and the pads 6 to 10. It is thus possible to easily and quickly change the pads 6 to 10 by way of these adapters.

A sufficiently high pressure of the pads 6 to 10 against a printing block arranged below (see FIG. 4) is produced by the magnetic push rods 30 to 34 in order to wet the pads 6 to 10 with the selected printing patterns. Instead of the magnetic push rods 30 to 34, push rods may also be used which can be selectively extended through a rotation of 72° in each case by way of a camshaft having five cams. Other drive mechanisms which operate in a selective manner and, for example, are based on pneumatic actuators, hydraulic actuators or miniaturized spindle drives are also possible.

The magnetic push rods 30 to 34 may be connectable in a row on either side so as to create character sequence of any length, if necessary.

Figure 4:
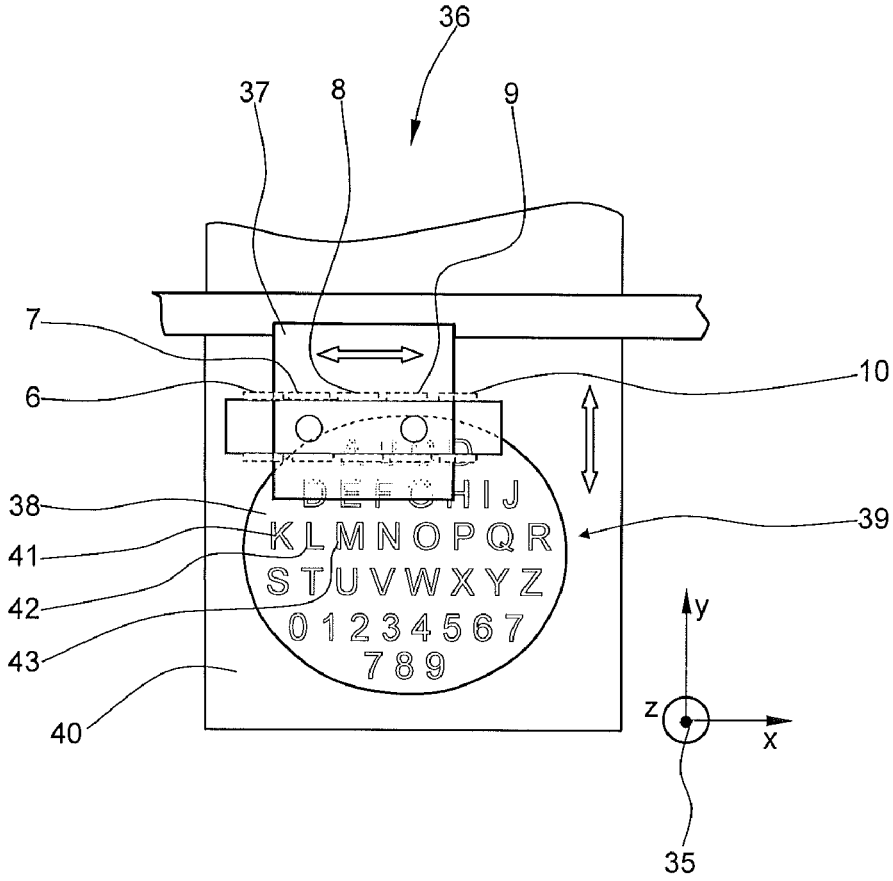
FIG. 4 is a schematic functional view of a wetting station from the front.
Figure 5:
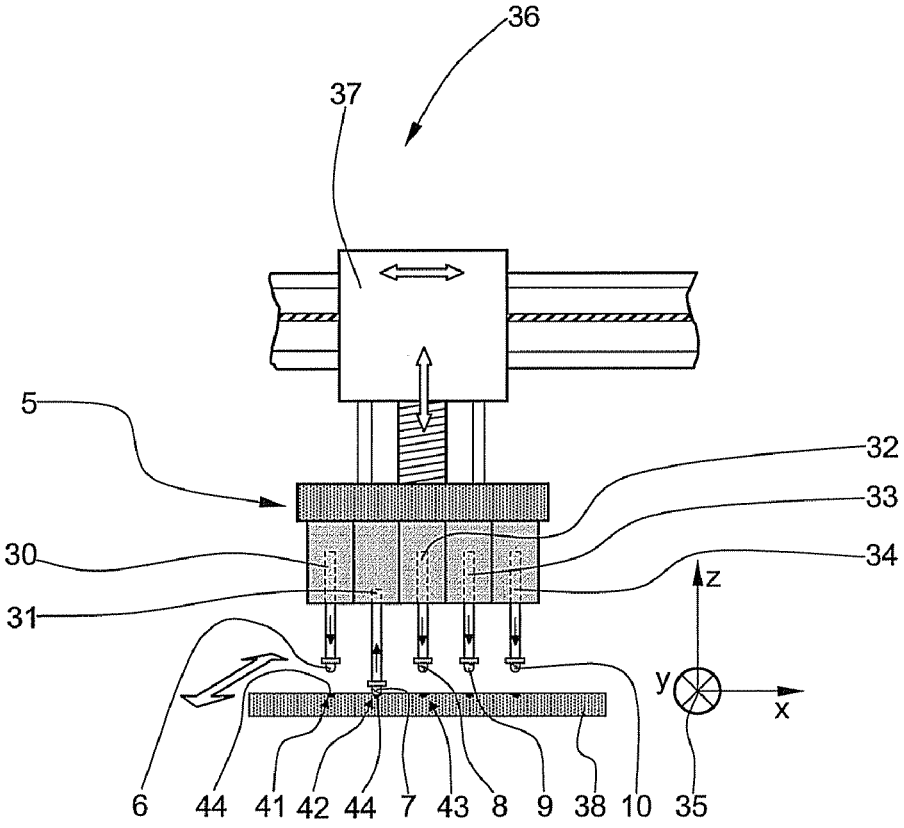
FIG. 5 is a plan view of the wetting station according to FIG. 4.

FIGS. 4 and 5, to which further reference will be made below, show a plan view and a front view of a wetting station having a printing block and a pad unit.

A wetting station 36 comprises a holder 37, in which the pad unit 5 is removably received by way of suitable fixing means. A printing block 39 configured as a slightly elliptical one-piece plate 38 and having a constant material thickness is arranged below the holder 37 with the pad unit 5. The plate 38 is preferably received in a removable manner in a further holder 40 so entire sets of characters for example can be replaced. The holders 37, 40 can be moved in the direction of the white double-headed arrow parallel to the x- and y-axes of the coordinate system 35 by way of positioning means (not shown in greater detail). Furthermore, a further positioning means enables the holder 37 to be moved in a perpendicular manner, parallel to the z-axis. The positioning means may, for example, be formed of spindles driven by electric motors or toothed belts moved by stepping motors.

A plurality of character dies is embedded in the plate 38 made of a tough steel alloy, of which character dies 41 to 43 ("K", "L", "M") of the set of characters shown and arranged next to one another are provided with a reference numeral, as an example for all the others. The easily recessed character dies may be formed, for example, by milling, etching. EDM or laser erosion. The printing ink is brushed into the character dies by way of a blade (not shown). By correspondingly moving the pad unit 5 and/or plate 38 relative to one another, a pad 6 to 10 to be wetted is positioned above the selected character die. The distance between the pad unit 5 and the plate 38 can subsequently be reduced as far as possible by way of vertical movement along the z-axis, in such a way that the selected pad 7 contacts the character die 41, for example by way of the magnetic push rod 31, and the selected printing pattern "K" is transferred onto said pad. This process is repeated until all five pads 6 to 10 carry the desired printing patterns. The pad unit 5 thus prepared is then removed from the holder 37 of the wetting station 36 and inserted into the device 1 (see numbers 1 and 2), by means of which the character sequence is applied to the surface 18 of the aircraft.

Figure 6:
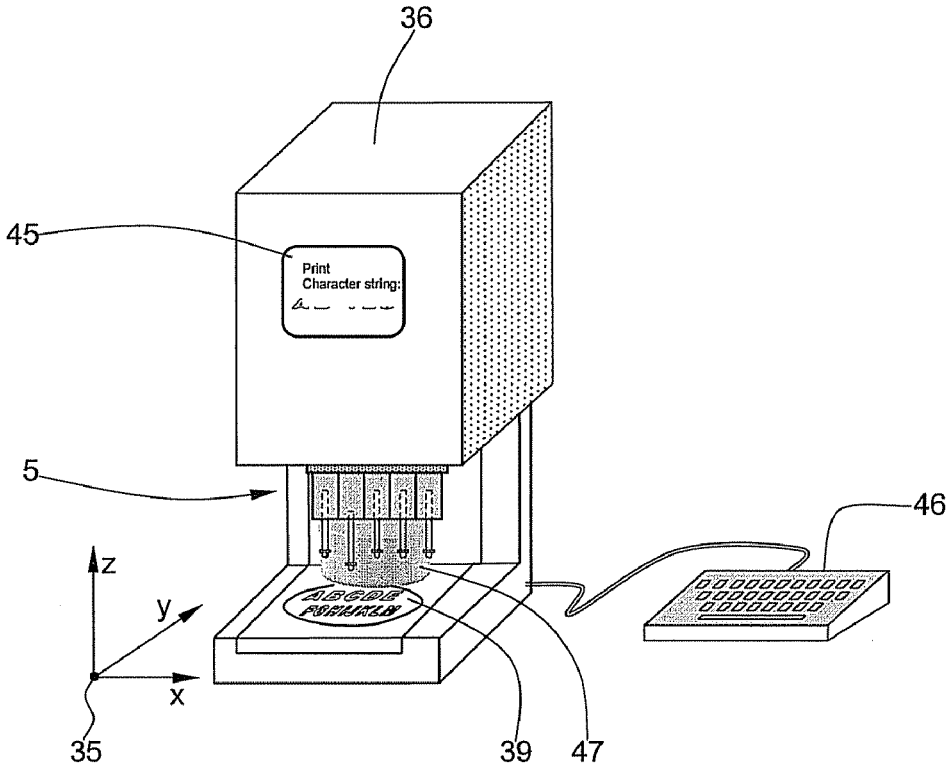
FIG. 6 is a perspective view of an exemplary wetting station comprising an input means and an optical output means.

FIG. 6 is a schematic perspective New of a possible technical embodiment of the wetting station 36 with the pad unit 5, which can be moved parallel to the x-axis and to the z-axis of the coordinate system 35 and of the printing block 39, which can be positioned parallel to the y-axis of the coordinate system. The wetting station 36 may have an optical display means 45 which, in the embodiment shown, is formed of an alphanumeric display or screen, and preferably an LCD display. The printing patterns to be applied to the pad unit 5 can set by a user via an input means 46, in this case a keyboard, the accuracy of the input information then being checked via the display means 45. In FIG. 6 the printing pattern "AB 123" is being transferred to the pad unit 5. The wetting station 36 also has a blade means 47 comprising a blade contained therein (not visible in this case however) for inserting the printing ink, so as to be as flush with the edges as possible (i.e. with no excess printing ink), into the character dies of the printing block 39. Furthermore, the wetting station 36 may have a stripping means (not shown), with which any excess printing ink can be fully removed from the pads 6 to 10 before said pads are newly wetted. The printing quality can thus be maintained, even after many printing procedures.

In order to reduce the total production costs of the wetting station 36, the printing block 39 is preferably moved only parallel to the x-axis and to the y-axis. The pad unit 5 with the pads 6 to 10 thus only needs to be positioned in the vertical direction parallel to the z-axis. The printing patterns are removed from the printing block by individually lowering the pads 6 to 10 by way of the magnetic push rods onto the printing block 39 into the respective x and y positions.

The control and regulation means preferably integrated directly into the wetting station 36 controls all processes inside the wetting station 36 apart from the device 1, which acts in a purely mechanical manner.

List of Reference Numerals

1 device
2 housing
3 first hand grip
4 second hand grip
5 pad unit
6 pad
7 pad
8 pad
9 pad
10 pad
11 recipient
12 projecting rod
13 projecting rod
14 projecting rod
15 hand lever
16 double-headed arrow
17 (complete) printing pattern
18 (aircraft) surface
19 metal fitting
20 longitudinal axis (device)
21 point of rotation
22 gripping portion
23 tooth portion
24 toothed rack
25 arrow
26 tension spring
27 arrow
28 lock
29 set wheel
30 magnetic push rod
31 magnetic push rod
32 magnetic push rod
33 magnetic push rod
34 magnetic push rod
35 coordinate system
36 wetting station
37 holder (pad unit)
38 plate
39 printing block
40 holder (printing block or plate)
41 character die
42 character die
43 character die
44 printing ink
45 display means (LCD display, LCD monitor)
46 input means (keyboard)
47 blade means

The invention claimed is:

1. A device for applying information onto a surface of an aircraft, wherein the information is applicable in variable locations and is modifiable, comprising:

a) a pad unit comprising at least one pad which is made of a silicone-free rubber and which is hollow on the inside, at least in part;

b) at least one hand grip;

c) a press-on mechanism for the pad unit;

d) at least one support which rests against the surface; and e) a housing;

wherein a printing pattern is formed on the at least one pad with a polyurethane lacquer containing at least two components;

wherein a wetting station comprises at least one printing block with at least one character die, it being possible to insert the printing ink, with no excess, into the at least one character die by way of at least one blade means; and wherein the printing block is a plate, it being possible to select a plurality of different character dies for wetting each pad by moving the pad unit received in a holder and/or the plate relative to one another.

2. The device according to claim 1, wherein the at least one pad can be wetted in a wetting station with a printing pattern, in particular in the form of at least one number and/or at least one letter.

3. The device according to claim 1, wherein a complex printing pattern is formed by combining at least two printing patterns on at least two pads.

4. The device according to claim 1, wherein by way of the at least one pad, the printing ink arranged in a selected character die can be lifted out of said die and transferred to an upper face of the pad in order to create a corresponding printing pattern.

5. The device according to claim 1, wherein the at least one pad is received in the pad unit so as to be vertically mobile, in particular by way of a magnetic push rod.

6. The device according to claim 1, wherein the press-on mechanism comprises a toothed rack which is connected to the pad unit, the toothed rack being engaged with a tooth portion connected to the hand lever so as to convert a pivoting movement of the hand lever into a horizontal movement of the pad unit.

7. The device according to claim 1, wherein at least one spring is provided for automatically lifting the pad unit and for creating a defined pressure of up to 50 N.

8. The device according to claim 1, wherein the support is a substantially cuboidal recipient, in which the pad unit is moveably received and on which at least three projecting rods are arranged.

9. The device according to claim 1, wherein the at least one pad is made using an elastomer, in particular using a silicone-free rubber, and an upper face of the at least one pad is convex.

10. The device according to claim 1, wherein at least one positioning aid is provided for positioning the device on the surface of the aircraft.

11. A device for applying information onto a surface of an aircraft, wherein the information is applicable in variable locations and is modifiable, comprising:

a) a pad unit comprising at least one pad which is made of a silicone-free rubber and which is hollow on the inside, at least in part;

b) at least one hand grip;

c) a press-on mechanism for the pad unit;

d) a hand lever for actuating the press-on mechanism in combination with the at least one hand grip;

e) at least one support which rests against the surface; and f) a housing;

wherein a printing pattern is formed on the at least one pad with a polyurethane lacquer containing at least two components;

wherein a wetting station comprises at least one printing block with at least one character die, it being possible to insert the printing ink, with no excess, into the at least one character die by way of at least one blade means; and wherein the printing block is a plate, it being possible to select a plurality of different character dies for wetting each pad by moving the pad unit received in a holder and/or the plate relative to one another.

* * * * *